US005223057A

United States Patent [19]

Mueller et al.

[11] Patent Number: 5,223,057

[45] Date of Patent: Jun. 29, 1993

[54] MONOPROPELLANT AQUEOUS HYDROXYL AMMONIUM NITRATE/FUEL

[75] Inventors: Kurt F. Mueller; Manfred J. Cziesla, both of Washington, D.C.

[73] Assignee: The United States of America as represented by the Secretary of the Navy, Washington, D.C.

[21] Appl. No.: 812,567

[22] Filed: Mar. 28, 1969

[51] Int. Cl.[5] ..... C06B 31/00

[52] U.S. Cl. ..... 149/45; 149/46; 60/214; 60/217

[58] Field of Search ..... 149/45, 46, 109; 60/214, 217

[56] References Cited

U.S. PATENT DOCUMENTS

| | | | |
|---|---|---|---|
| 2,584,803 | 2/1952 | Hannum | 149/45 |
| 3,117,415 | 1/1964 | Greene | 60/215 |
| 3,125,852 | 3/1964 | Blackwell et al. | 60/217 |
| 3,190,777 | 6/1965 | Breza et al. | 149/45 |
| 3,352,109 | 11/1967 | Lissant | 60/217 |
| 3,700,393 | 10/1972 | Mueller | 60/214 |
| 3,811,358 | 5/1974 | Morse | 149/2 |
| 3,941,626 | 3/1976 | Phillips et al. | 149/36 |
| 3,953,261 | 4/1976 | Duncan et al. | 149/36 |
| 3,953,262 | 4/1976 | Duncan et al. | 149/36 |
| 4,402,775 | 9/1983 | Wood et al. | 149/46 |
| 4,407,988 | 9/1977 | Weill et al. | 149/46 |
| 4,878,968 | 11/1989 | Willer et al. | 149/45 |
| 4,946,521 | 8/1990 | Walker et al. | 149/46 |
| 5,060,973 | 10/1991 | Giovanetti | 149/45 |

OTHER PUBLICATIONS

Jacobson, "Encyclopedia of Chemical Reactions", vol. V, p. 123, Reaction V-475, Reinhold Pub. Corp. (1953) New York.

*Primary Examiner*—Edward A. Miller

[57] ABSTRACT

A liquid monopropellant composition comprising the water solution of an hydroxylammonium nitrate and a compatible water soluble or water dispersible fuel.

8 Claims, No Drawings

MONOPROPELLANT AQUEOUS HYDROXYL AMMONIUM NITRATE/FUEL

BACKGROUND OF THE INVENTION

This invention relates generally to liquid monopropellant compositions and more particularly to a liquid monopropellant composition especially useful for underwater and surface propulsion of ordnance vehicles which utilize piston or turbine engines.

The simplest type of liquid propellant system is the liquid monopropellant which basically comprises either a fuel dissolved in an oxidizer (or vice versa), or a liquid solution in which all of the oxidizer and fuel necessary for combustion is combined in a single molecule. This type of propellant is generally preferred over other compositions because of its high degree of thrust control and because of the simplicity of the feed system necessary to feed the composition to the combustion chamber of the reaction motor; there being required only a single pump, a single storage tank and a single feed line. Presently, however, the state-of-the-art of liquid monopropellants is generally inadequate for military and other applications since a great portion of their combustion products are not water soluble and contain corrosive gases. Insoluble products are deleterious to military operations because they are the prime cause of surface wake which facilitates enemy detection of an underwater vessel or vehicle, while the presence of corrosive gases such as HCl after combustion in the motor chambers of the propelled vehicles is deleterious for obvious reasons.

Other disadvantages of conventional liquid monopropellants result from their high sensitivities, high freezing points and toxicity, which cause many problems in the areas of handling and storage.

SUMMARY OF THE INVENTION

It is therefore one object of this invention to provide a new liquid monopropellant which generates a high percentage of water soluble gases on combustion.

Another object of this invention is to provide a liquid monopropellant which upon combustion does not produce corrosive materials.

Still another object of this invention is to provide a liquid monopropellant which has a lower freezing point and a lower sensitivity.

A further object of this invention is to provide a liquid monopropellant which is especially suited for underwater propulsion applications.

These and other objects are achieved by providing a water solution of a hydroxylammonium nitrate oxidizer and a compatible water soluble or water dispersible fuel.

DESCRIPTION OF THE PREFERRED EMBODIMENTS

The monopropellants of this invention are prepared by forming a water solution or emulsion of an hydroxylammonium nitrate oxidizer, such as hydroxylammonium nitrate (HAN) or derivatives thereof, e.g., the N-methyl, N-ethyl, O-methyl or O-ethyl derivatives of HAN, and a water soluble or water dispersible fuel wherein said oxidizer, fuel and water are present in the weight ratio of about 1:9:10 to 17:1:2.

The water in the present composition acts as the desensitizing agent for the HAN oxidant and also serves to provide the necessary cooling to control the flame temperature of the combustion reaction. For these purposes, it is desirable to use water in an amount sufficient to provide a water to oxidizer ratio in the range of 1:10 to 16:2, and more preferably from about 5% to about 100% based on the combined weight of the fuel and oxidant.

The quantity of fuel used in the composition is not critical and is dependent generally on the particular type selected and on the percentage of insoluble exhaust products which can be tolerated for a given application. The more closely the quantity of fuel and oxidant approximates the stoichiometric balance, the greater the percentage of water soluble exhaust products provided. In general, sufficient fuel should be present to provide the weight ratio of fuel to oxidant of from about 1:10 to about 16:1.

For the purposes of this invention, a large number of fuels are operable herein. For example, to provide a composition with low toxicity, non-volatile fuels are employed such as, ammonium nitrates and derivatives thereof, like isopropylammonium nitrate, methylammonium nitrate, ethylammonium nitrate, diethylammonium nitrate, ethylmethylammonium nitrate; polyhydric alcohols, such as glycerin; sugars, like sucrose; amides such as formamide and acetamide; amino acids such as α-aminopropionic acid and water soluble polymers such as hydrolyzed polyvinylacetate, polyacrylic esters and polymethacrylic esters; and mixtures thereof.

Other operable fuels include polyhydric alcohols such as ethylene glycol, diethylene glycol, triethylene glycol, tetramethylene glycol, ethylene glycol monoethyl ether, propylene glycol, dipropylene glycol, dimethoxytetraethylene glycol, diethylene glycol monomethyl ether, the acetate of ethylene glycol monoethyl ether and the acetate of diethylene glycol monoethyl ether; ketones, for example, include acetone and methyl butyl ketone; monohydric alcohols such as methanol, propanol, butanol, phenol and benzyl alcohol; ethers, such as dimethyl and diethyl ether, and dioxane; also, the nitriles such as acetonitrile; the sulfoxides such as dimethylsulfoxides; sulfones such as tetrahydrothiophene-1,1-dioxide; the amines such as ethylamine, diethylamine, ethanolamine, hydroxylamine; substituted hydroxylamines such as methyl and ethyl hydroxylamine; and mixtures thereof.

Among the water dispersible fuels which may be used are fuel oil, JP4 fuel, diesel fuel and commercial tall oils. When the water dispersible fuels are used, they must be dispersed in the water by the use of a suitable surfactant such as alkaryl sulfonates, the long chain aliphatic sulfates and the like.

Many additives may be added to this composition without departing from the present invention. For example, various stabilizers may be included such as ethylenediaminetetraacetic acid, the salts thereof and similar complexing agents.

The compositions as described will provide up to about 70 percent or more of water soluble combustion products and noncorrosive combustion products in the form of water, nitrogen and carbon dioxide thereby rendering the compositions especially suited for underwater propulsion where minimum wake characteristics and noncorrosiveness are essential.

The general nature of the invention having been set forth, the following examples are presented as specific illustrations thereof. It will be understood that the invention is not limited to these examples, but is susceptible to different modifications that will be recognized by one of ordinary skill in the art.

EXAMPLE 1

Composition % weight

HAN 56.91
Isopropylammonium nitrate 18.09
$H_2O$ 25.00

EXAMPLE 2

Composition % weight

HAN 59.15
1,4-dioxane 10.85
$H_2O$ 30.00

The physical properties of the compositions of Examples 1 and 2 are illustrated in Table I.

TABLE I

| Example | Density (g/cm$^3$) | Freezing Point (°C.) | DIA Exotherm (°C.) | Specific Impulse (sec) | Density Impulse (secxg/cm$^3$) | Condensable Exhaust Prod. (vol. %) |
|---|---|---|---|---|---|---|
| 1 | 1.363 | −60 | 162 | 212 | 289 | 74 |
| 2 | 1.375 | −41 | 162 | 210 | 289 | 74 |

Upon combustion of the compositions of Examples 1 and 2 the products consisted of steam, carbon dioxide and nitrogen and no corrosive gases.

The thermal stability of the HAN-based formulations of Examples 1 and 2 was tested at 80° C. for a period of 34 days after which period the decomposition was determined to be negligible.

The sensitivity of the compositions of Examples 1 and 2 were measured by standard tests and the results are summarized hereinafter in Table II. The Card gap test (JANAF Test No. 1) is performed by filling a Teflon coated steel pipe 1" in diameter and 3" high with the monopropellant. A loose steel plate is mounted on top of this pipe. Cellulose acetate cards are stacked between the bottom of this filled pipe and an explosive tetryl pellet, which is fitted with a suitable igniting device. The tetryl is ignited and the results are recorded as the number of cellulose acetate cards necessary to prevent ignition of the monopropellant and concomitant damage to the loose steel plate.

The other sensitivity tests employed are also conventional in nature. For example, the bullet impact test entailed confining the liquid monopropellant in a 2" diameter and 66" long pipe and firing a bullet perpendicular to the pipe and completely therethrough. In the case of a negative test the bullet goes through the pipe without any detonation. The blasting cap test involves placing the liquid monopropellant in an open cup which is placed upon a lead cylinder. A blasting cap is immersed in the monopropellant and ultimately set off. A negative test does not produce any detonation.

TABLE II

| Example | Card Gap Test (JANAF Test #1) Ambient Temp. | Bullet Impact Test | Blasting Cap Test | Unconfined Burning |
|---|---|---|---|---|
| 1 | 0 cards | negative | negative | no detonation |
| 2 | 0 cards | negative | | no detonation |

Many modifications of the present invention may be made without departing from the spirit or scope thereof. For example, rather than mix all of the required water initially with fuel and oxidant, a portion of the required water may be sprayed into the reaction motor chamber during combustion in which instance the water would have the same desensitizing and flame temperature controlling influence.

What is claimed and desired to be secured by Letters Patent of the United States is:

1. A liquid monopropellant composition comprising: (1) an oxidizer selected from the group consisting of hydroxylammonium nitrate and the N-methyl, N-ethyl, O-methyl and O-ethyl derivatives thereof; (2) a compatible fuel selected from the group consisting of (a) water soluble fuels selected from the group consisting of nitrates, ethers, nitriles, hydrolyzed polyvinyl acetates, polyacrylic esters, polymethacrylic esters, polyhydric alcohols, monohydric alcohols, amides, amines, amino acids, sulfoxides, sulfones, Ketones, sugars and mixtures thereof and (b) water dispersible fuels selected from the group consisting of fuel oil, JP4 fuel, diesel fuel and commercial tall oils; and (3) water; wherein said oxidizer, fuel and water are present in the weight ratio of 1:9:10 to 17:1:2.

2. The liquid monopropellant of claim 1 wherein the compatible fuel is a water soluble fuel.

3. The liquid monopropellant of claim 1 wherein the fuel is a water dispersible fuel containing a minor portion of a suitable surfactant.

4. The liquid monopropellant of claim 1 wherein said oxidizer is hydroxylammonium nitrate.

5. The liquid monopropellant of claim 1 wherein the oxidizer and fuel are present in approximately stoichiometric amounts.

6. The liquid monopropellant of claim 2 wherein said water soluble fuel is selected from the group consisting of isopropylammonium nitrate, methylammonium nitrate, ethylammonium nitrate, diethylammonium nitrate and ethylmethylammonium nitrate.

7. The liquid monopropellant of claim 2 wherein said water soluble fuel is dioxane.

8. The liquid monopropellant of claim 2 wherein said water soluble fuel is isopropylammonium nitrate.

* * * * *